US005088455A

United States Patent [19]

Moretz

[11] Patent Number: 5,088,455

[45] Date of Patent: Feb. 18, 1992

[54] ROLLER VALVE LIFTER ANTI-ROTATION GUIDE

[75] Inventor: Ralph D. Moretz, Jackson, Mich.

[73] Assignee: Mid-American Products, Inc., Jackson, Mich.

[21] Appl. No.: 743,901

[22] Filed: Aug. 12, 1991

[51] Int. Cl.[5] ..... F01L 1/46

[52] U.S. Cl. ..... 123/90.5; 123/90.51

[58] Field of Search ..... 123/90.48, 90.5, 90.51; 74/606 R, 607

[56] References Cited

U.S. PATENT DOCUMENTS

| | | | |
|---|---|---|---|
| 3,668,945 | 6/1972 | Hofmann | 74/569 |
| 3,886,808 | 6/1975 | Weber | 123/90.48 |
| 4,173,954 | 11/1979 | Speckhart | 123/90.5 |
| 4,207,775 | 6/1980 | Lintott | 123/90.5 |
| 4,448,155 | 5/1984 | Hillebrand et al. | 123/90.5 |
| 4,704,995 | 11/1987 | Soeters, Jr. | 123/90.5 |
| 5,022,356 | 6/1991 | Morel, Jr. et al. | 123/90.5 |

FOREIGN PATENT DOCUMENTS

| | | | |
|---|---|---|---|
| 2062157 | 5/1981 | United Kingdom | 123/90.5 |

*Primary Examiner*—E. Rollins Cross
*Assistant Examiner*—Weilun Lo
*Attorney, Agent, or Firm*—Beaman & Beaman

[57] ABSTRACT

The invention pertains to a guide for roller valve lifters for internal combustion engines which prevents rotation of the valve lifters. The guide is molded of a synthetic polymeric material to define sockets receiving the ends of the valve lifters having flats defined thereon. The sockets of the guide are partially defined by cantilever supported fingers engaging the valve lifter flats, preferably with zero clearance, whereby the guide prevents rotation of the valve lifter about its axis.

20 Claims, 3 Drawing Sheets

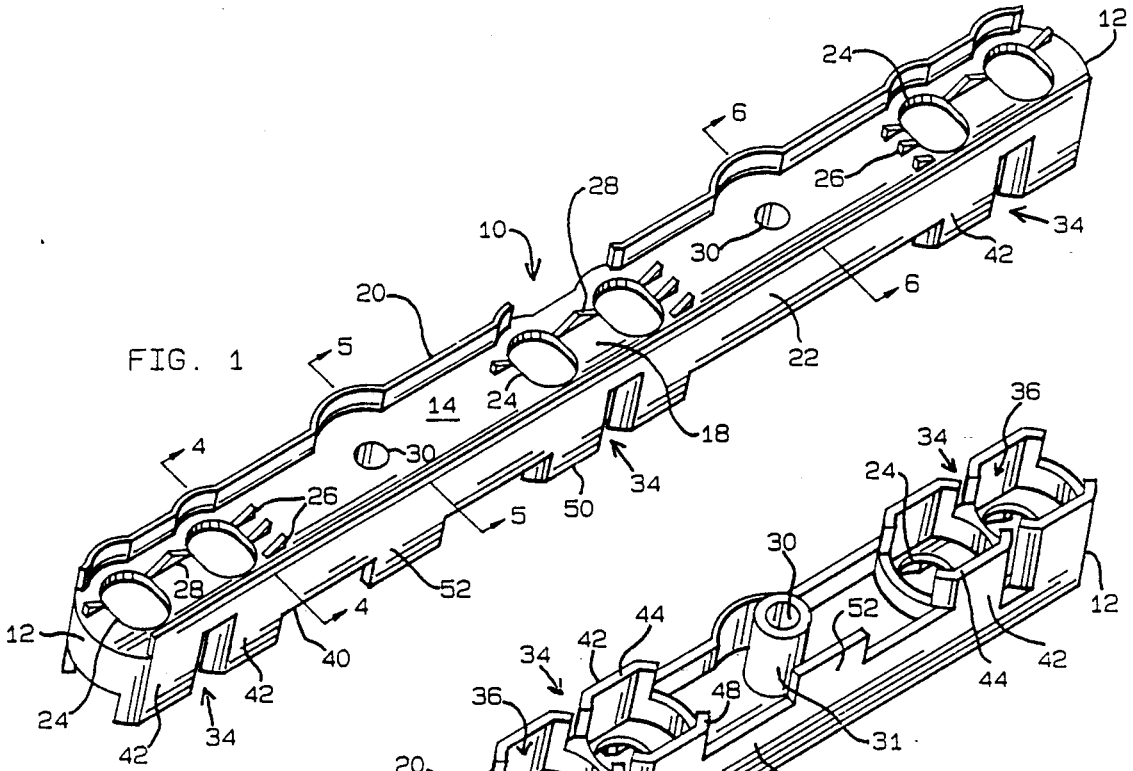
FIG. 1
FIG. 2
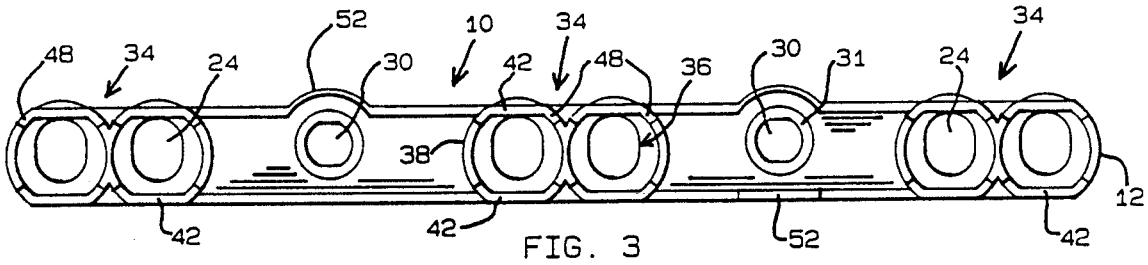
FIG. 3
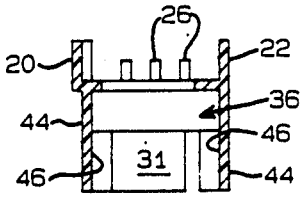
FIG. 4
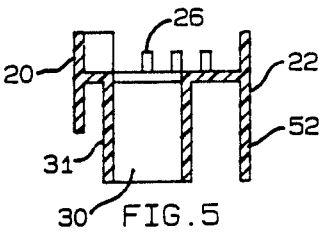
FIG. 5
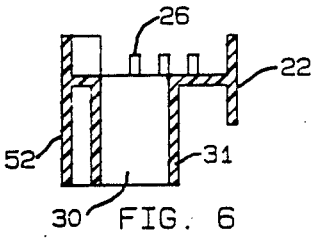
FIG. 6

ROLLER VALVE LIFTER ANTI-ROTATION GUIDE

BACKGROUND OF THE INVENTION

1. Field of the Invention

The invention pertains to guides for roller valve lifters for internal combustion engines which prevent rotation of the valve lifter about its axis in order to maintain the lifter roller properly oriented to the associated cam lobe.

2. Description of the Related Art

Roller valve lifters for internal combustion engines use a roller at the lower end of the valve lifter for engaging a cam lobe. The use a roller with the valve lifter reduces friction, provides extended cam life, improves engine efficiency and vehicle mileage and improves lifter life. Because the lifter roller must rotate about an axis parallel to the axis of rotation of the camshaft operating the lifters, guide means must be used to properly maintain the orientation of the axis of the lifter roller to the axis of the camshaft.

To properly orient the roller of an engine valve lifter the outer end of the lifter is provided with parallel flat surfaces located upon opposite sides of the lifter axis. These flat surfaces are oriented to the axis of the valve roller and cooperate with guide structure mounted upon the engine to maintain the proper orientation of the valve lifter roller to the cam lobe during engine operation while the valve lifter reciprocates within its bore defined in the engine block.

Previously, guides for roller valve lifters of internal combustion engines are formed of stamped metal, or powdered metal, having an opening of a non-circular configuration including flats which corresponded to the configuration of the lifter flats. The lifter reciprocates within the guide openings with a controlled clearance, the dimension across the guide flats being less than the basic diameter of the cylindrical lifter. A retainer is employed to locate and mount the guide upon the engine.

Such conventional metal guides have several disadvantages. For instance, as the guide restrains the lifter against rotation restraint is a function of metal-to-metal interface contact, and wear will occur on the interfaces which increases the tolerances therebetween, and as wear occurs the ability of the guide to properly orient the valve lifter with respect to the cam lobe diminishes, resulting in excessive roller and cam wear.

Another deficiency of conventional metal valve lifter anti-rotation guides results from the fact that the metal guide is heavy and cumbersome, and hence are expensive to manufacture and produce. Further, metal valve lifter guides generate unwanted engine noise.

Yet another deficiency of conventional metal valve lifter guides is due to the multi-part nature of the assembly which results in time consuming assembly which is subject to errors which can lead to engine failure and significant damage.

OBJECTS OF THE INVENTION

It is an object of the invention to provide a non-metallic synthetic polymeric anti-rotation guide for internal combustion engine roller valve lifters which overcomes the aforementioned deficiencies of conventional metal valve lifter guides.

Another object of the invention is to provide a valve lifter guide which requires fewer parts than previous guides, and provides better anti-rotation guidance of the valve lifters.

A further object of the invention is to provide a molded valve lifter guide which is easy to assemble, and which renders improper assembly substantially foolproof.

An additional object of the invention is to provide a roller valve lifter guide capable of very accurately restraining the valve lifter against rotation and wherein zero clearance or tolerance between the guide and valve lifter is achievable.

Yet another object of the invention is to provide a molded polymeric material valve lifter guide which is quiet in operation, relatively lightweight, can be manufactured at a lower cost than conventional guides, and has a built in lubricity.

A further object of the invention is to provide a molded roller valve lifter guide which does not require a secondary retainer to position the guide upon the associated engine.

SUMMARY OF THE INVENTION

The valve guide of the invention is used with conventional roller valve lifters which reciprocate within cylindrical bores defined within the associated internal combustion engine block. Such valve lifters are of a generally cylindrical configuration having an inner end upon which a roller is mounted for rotation about an axis diametrically related to the valve lifter configuration. The roller engages the cam lobe of a camshaft whereby rotation of the camshaft axially displaces the lifter.

The outer end of the lifter is engaged by a valve push rod whereby the axial reciprocation of the lifter is transmitted to the engine valve structure. As the axis of the lifter roller must be parallel to the camshaft axis so that a true rolling action is present at the cam lobe the valve lifter must be restrained against rotation about its axis as it rotates. To this end, the outer end of the valve lifter is provided with spaced parallel flat orientation surfaces separated by a distance less than the diameter of the normal configuration of the lifter.

In the practice of the invention, the anti-rotation guide cooperates with the valve lifter flats to maintain the lifter in a predetermined angular relationship with respect to its longitudinal axis. In accord with the inventive concepts, the guide is molded of a synthetic polymeric material and includes structure for direct association with the valve lifter flats.

Preferably, the anti-rotation guide of the invention is formed by the injection molding of a polyamide material, such as Nylon type 6/6 which is glass fiber reinforced. Further, it is preferred that this material be modified with a molybdenum disulfide to increase the lubricity of the material as relative movement between the valve lifters and guide occurs.

The valve lifter guide body can be formed in a number of configurations as determined by the particular engine in which the guide is to be used. As most automobile engines use two valves with each cylinder, i.e. a fuel intake valve and an exhaust valve, each cylinder will have two valve lifters associated therewith requiring a pair of guides for each cylinder. Accordingly, the lifter guide components are formed in two unit sets upon the body.

Guidance of the valve lifters is achieved by fingers homogeneously defined on the guide body. The fingers are of an elongated cantilever configuration, two fingers being used with each set, and the fingers include flat spaced opposed internal surfaces adapted to engage the valve lifter flat surfaces and thereby maintain the desired rotational orientation of the lifters. The internal surfaces of the fingers may be separated by a distance slightly less than the distance separating the associated lifter flats thereby resulting in zero clearance achieving very accurate guidance of the lifters.

Each pair of fingers at least partially defines a socket which receives the outer end of the valve lifter upon which its flats are defined. Preferably, the lateral edge portions of the fingers are obliquely disposed to the plane of the associated fingers internal surface forming web or wing portions whereby the wing portions stiffen and strengthen the fingers against deformation in a direction transverse to the plane of the fingers internal surfaces. By varying the width or angle of the wing portions the stiffness or flexibility of the fingers can be controlled for the particular application. In this manner, the fingers are reinforced, but are still capable of slight deformation as needed to maintain the zero clearance relationship with the associated valve lifter.

The molded body is provided with holes for receiving bolts for directly attaching the body to the engine block, and the body also includes holes in axial alignment with the axis of the sockets defined by the fingers, such holes receiving the valve push rods and permitting the rods to engage the outer ends of the lifters. To aid push rod assembly, guide means in the form of oblique surfaces are preferably defined on the guide body adjacent the openings to help guide the valve rods into the openings for engagement with the ends of the lifters. Such guides are homogeneously molded into the configuration of the guide body.

To simplify assembly, and reduce the likelihood of mis-assembly, the sets of sockets upon which the lifter guide fingers are defined may be interconnected with deformable thin wall webs which permit the sets to be substantially aligned with the associated valve lifters, but also permit minor deflection and alignment of the sets during installation and mounting of the guide to the engine.

BRIEF DESCRIPTION OF THE DRAWINGS

The aforementioned objects and advantages of the invention will be appreciated from the following description and accompanying drawings wherein:

FIG. 1 is a top perspective view of one embodiment of an anti-rotation guide for valve lifters in accord with the invention for a three cylinder engine bank, FIG. 2 is a perspective bottom view of the guide of FIG. 1, FIG. 3 is a bottom view of the valve lifter guide of FIG. 1, FIG. 4 is an elevational sectional view as taken along Section 4—4 of FIG. 1, FIG. 5 is an elevational sectional view as taken along Section 5—5 of FIG. 1, FIG. 6 is an elevational sectional view as taken along Section 6—6 of FIG. 1.

DESCRIPTION OF THE PREFERRED EMBODIMENTS

Figure 7:
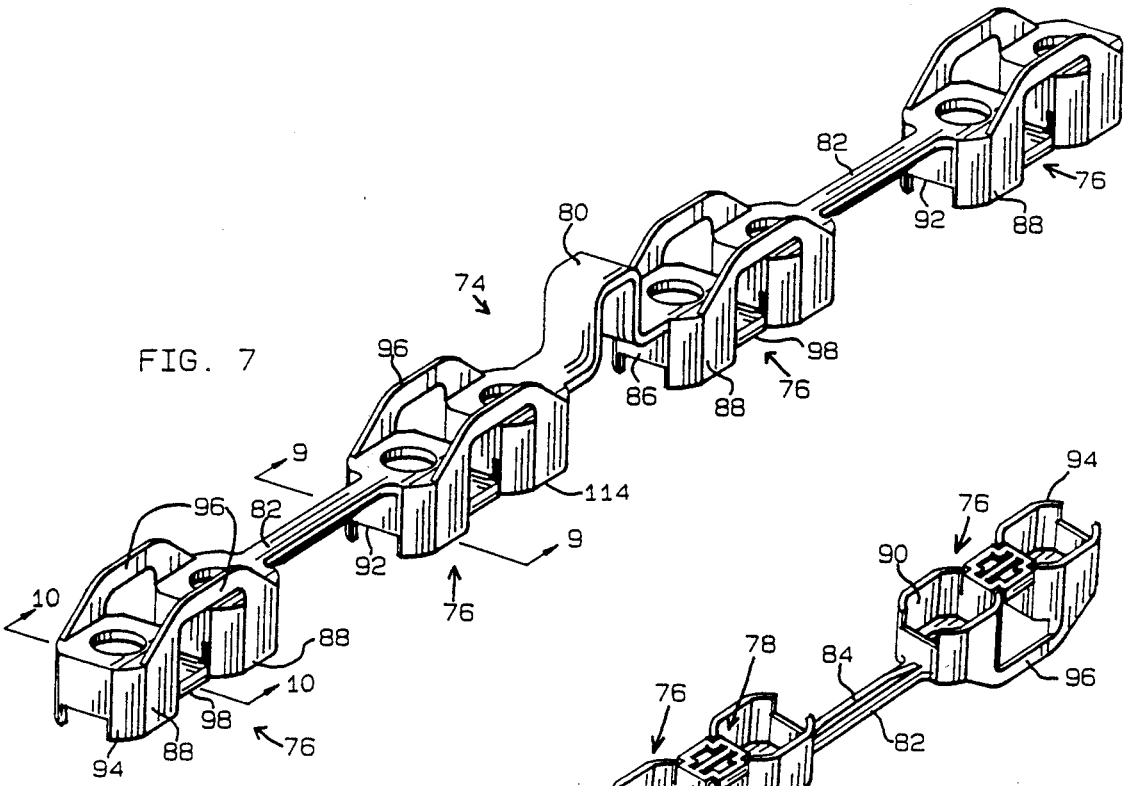
FIG. 7 is a top perspective view of another embodiment of anti-rotation valve lifter guide in accord with the inventive concepts, as would be used with a four cylinder or eight cylinder engine.
Figure 8:
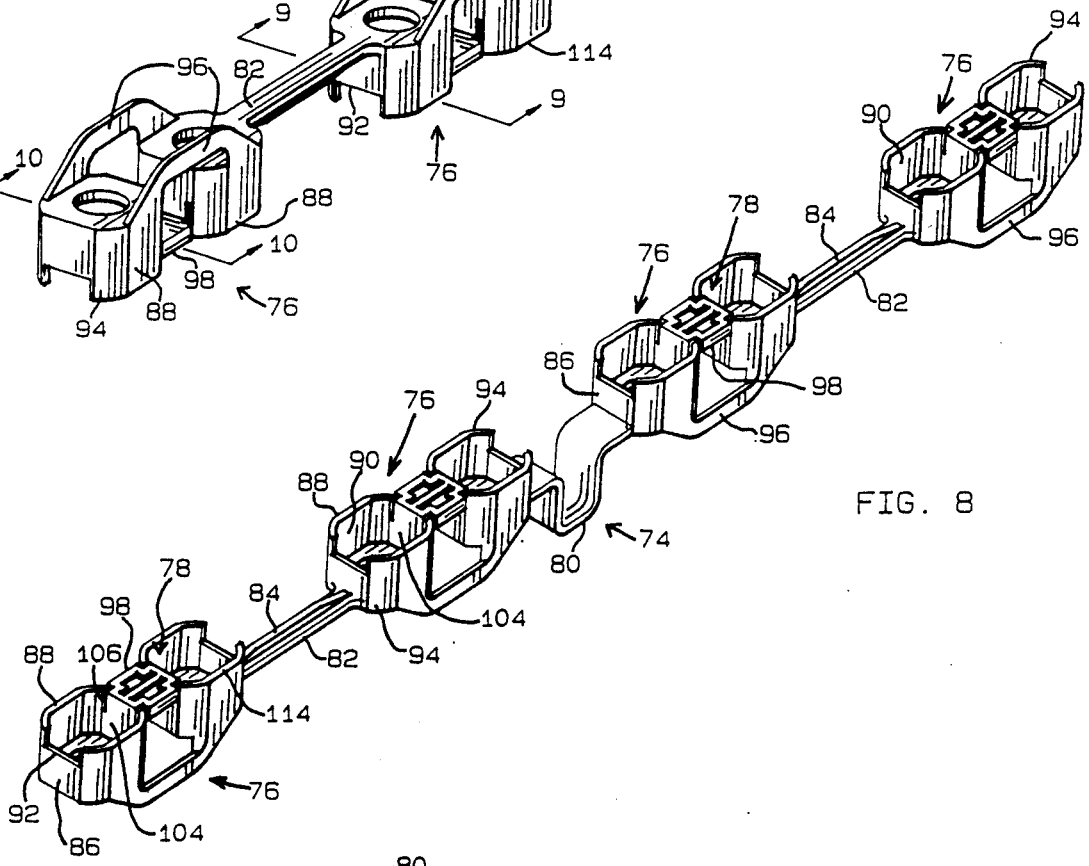
FIG. 8 is a bottom perspective view of the guide of FIG. 7.
Figure 9:
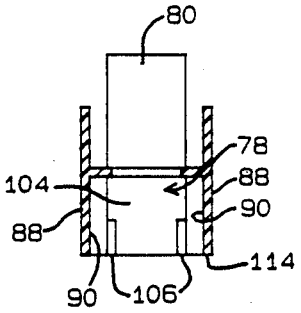
FIG. 9 is an elevational sectional view taken along Section 9—9 of FIG. 7.
Figure 10:
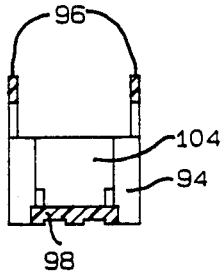
FIG. 10 is an elevational sectional view taken along Section 10—10 of FIG. 7.

As will be appreciated from a comparison of the embodiments of FIG. 1 and FIG. 7, the specific configuration of an anti-rotation guide for roller valve lifters in accord with the inventive concepts may significantly vary. However, as will be later apparent, the basic interrelationship of components of embodiments of guides incorporating the invention is similar.

With reference to FIGS. 1-6, an embodiment of roller valve lifter guide is illustrated which is of the type which would normally be used with a V-6 internal combustion engine. Such an engine employs an engine block of a V-configuration, three cylinders being located in each bank of the block. In such instance each of the engine cylinders requires a fuel intake valve and a gas exhaust valve, and associated valve structure, as known and partially shown in FIG. 11.

The valve lifter guide consists of an injection molded body 10 of an elongated configuration as will be appreciated from FIGS. 1-3. Preferably, the body is injection molded of a synthetic plastic polyamide such as Nylon, type 6/6, which is glass fiber reinforced. This material is modified with a molybdenum disulfide to increase the lubricity even beyond that which is inherently present with the nylon material. It is also to be understood that the body 10 could be molded of other materials, including ceramics, if the specific application requires the characteristics of such materials. The body 10 includes ends 12, an upper surface 14, a lower surface 16, a central region 18, and lateral edges 20 and 22. The general configuration of the body 10 is best appreciated from FIGS. 1 and 2.

Figure 11:
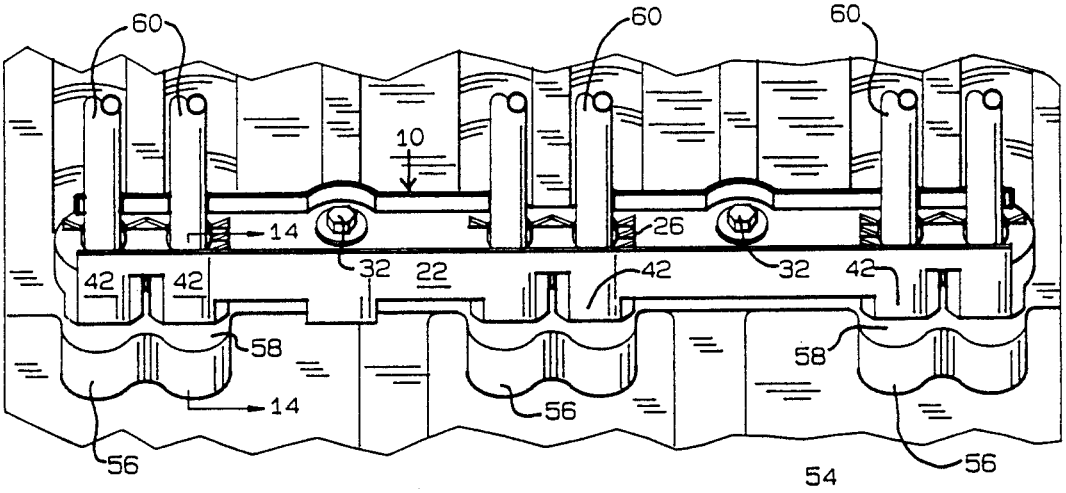
FIG. 11 is a perspective view of the guide of FIGS. 1-6 as mounted upon an internal combustion engine.

The body 10 is provided with valve push rod receiving openings 24 and the lateral edges 20 and 22 are each defined by a wall having edges which usually extend above and below the upper and lower surfaces 14 and 16. The upper body surface 14 may be provided with a plurality of guide wedges 26, and beveled guide wedges 28, adjacent the openings 24 for aiding in the assembly of the valve push rods with the valve lifters, as later described, and body mounting holes 30 are defined in the body as concentrically related to the cylindrical bosses 31, FIG. 2, which extend from the lower surface 16 whereby bolts 32, FIG. 11, are used to attach the guide body to the engine.

On its underside, the body 10 is provided with three sets 34 of sockets 36. Each of the pair of sockets of a set 34 are identical, two sets being located adjacent the ends 12, and a set being located at the central region 18.

Each of the sockets 36 are elongated having an axis defined by a portion of the body lower surface 16, and a generally circular hub 38 extending from the surface 16 to a distance equal to the wall lower edge 40, FIG. 2. Further, each of the sockets 36 is partially defined by a pair of fingers 42, constituting extensions of the lateral edge walls. Each of the fingers includes an outer free end 44 whereby the fingers are cantilever supported, and each finger includes a flat inner surface 46 which is in spaced opposed relationship to the inner surface 46 of the opposed finger defining a common socket 36. The opposed fingers 42 are reverse tapered for clearance purposes, as later described.

Each of the fingers 42 includes a lateral portion which defines a web 48 at the finger edge. The webs 48 generally form a plane which is transversely related t the plane of the associated finger internal surface 46, and the webs 48 reinforce the fingers against deformation in a direction transverse to the plane of the internal surfaces 46.

The finger lower edges 50, the ends of the bosses 31, and the ends of the columns 52 defined on the walls of edges 20 and 22 all lie within a common plane, and constitute a support surface for the body 10 when the body is bolted to an engine.

FIG. 11 illustrates a typical installation of the roller valve lifter guide as shown in FIGS. 1–6. In FIG. 11 the internal combustion engine is schematically illustrated at 54, and includes a bank having three cylinders, not shown, having embossments 56 which house the cylinder valve lifters in cylindrical bores in the known manner. The embossments 56 include a coplanar mounting surface 58, against which the finger ends 46 engage, and the guide body 10 is firmly affixed to the engine block by the pair of bolts 32 extending through holes 30 and bosses 31. The ends of the columns 52 and bosses 31 engage engine structure and shoulder bolts or inserts are used whereby tightening of the bolts 32 does not deform the body.

Valve push rods 60, two for each cylinder, extend through the openings 24 as apparent from FIG. 11. When inserting the valve push rods 60 the wedges 26 and 28 disposed adjacent the openings 24 aid in aligning the end of the rods with the desired opening, and if the ends of the rods engage the inclined surfaces of the wedges during assembly the inclined wedge surfaces will direct the end of the rods through the appropriate opening.

Figure 13:
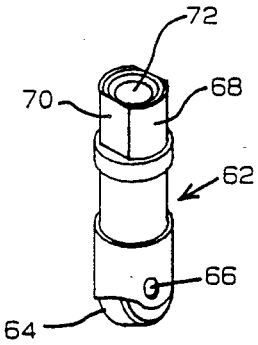
FIG. 13 is a perspective view of a roller valve lifter of the type with which the guide of the invention is used.
Figure 14:
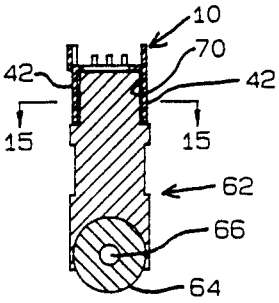
FIG. 14 is a sectional view of a roller valve lifter and associated guide as taken along Section 14—14 of FIG. 11, the push rod not being illustrated.

Valve lifters of conventional configuration are illustrated in FIGS. 13–14. The valve lifter 62 is of a generally cylindrical configuration and reciprocates within a reamed bore within the engine block. The lifter 62, at its inner end, includes a roller 64 rotatably mounted upon shaft 66, and at its outer end, the valve lifter includes a cylindrical surface 68 at an upper end. A pair of spaced parallel flat surfaces 70 are defined on the outer end of the valve lifter intersecting the cylindrical surface 68, and the flat surfaces 70 constitute the guide surfaces for the valve lifters which cooperate with the fingers of the lifter guide. The outer end 72 of the valve lifter engages the inner end of a valve push rod 60. Of course, the lifter flat surface 70 is oriented in a particular manner to the axis to the shaft 66 of the roller 64, and in the disclosed embodiment the plane of the flat surfaces is parallel to the axis of shaft.

Figure 15:
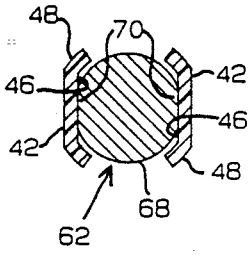
FIG. 15 is a plan sectional view taken through the upper end of the valve lifter and guide as taken along Section 15—15 of FIG. 14.

The outer end of each valve lifter 62 is received within a socket 36 of the lifter guide body 10 as shown in FIGS. 14 and 15. The distance separating the lifter flat surfaces 70 is preferably slightly greater than the distance separating the finger internal surfaces 46 of a common socket at ends 50 whereby a negative clearance originally exists and a zero clearance exists between the fingers 42 and the lifter surfaces 70 when in engagement. The opposed fingers 42 are formed with a reverse taper, i.e. the distance separating the inner surfaces 46 adjacent the finger end edges 50 is less than the distance separating opposed inner surfaces 46 deeper in the associated socket 36 adjacent the lower surface 16. This reverse finger taper causes the fingers to engage the lifter flat surfaces only at the edges 50 with zero clearance and a slight clearance between the fingers and lifter flat surfaces will exist deeper within the socket. The resiliency or spring of the fingers 42 permits a zero clearance to accurately position the lifters without producing excessive frictional resistance to movement of the lifters between the fingers, and undue stress is not placed on the guide socket.

As will be appreciated from FIG. 15, the finger webs 48 extend beyond the lifter cylindrical surface 68, and as previously stated, the finger webs reinforce the associated finger 42 against deformation and the dimension of the webs will be predetermined to provide the desired degree of finger resiliency or stiffness resisting deformation.

During operation, the axial displacement of the valve lifter 62 under the influence of the camshaft cam lobe, not shown, is less than the depth of the associated socket 36 and the associated fingers 42 will maintain the embraced valve lifter during all phases of its movement and maintain the proper rotational orientation of the valve lifter to its associated cam lobe.

The embodiment of FIGS. 7–10 and 12 may be used with four cylinder engines, or V-8 engines. In this embodiment of the invention, four sets of sockets are present, two sockets constituting a set for association with the valve lifters and push rods of each engine cylinder.

The body 74 of the embodiment of FIGS. 7–10 is formed by four identical sets 76 of sockets 78 interconnected by thin wall webs. The two central sets 76 are interconnected by the U-shaped center web 80, and the end sets are attached to their closest central set by webs 82 which include a reinforcing rib 84. The web 80 permits thermal expansion and contraction and maintains the four sets of sockets in the desired spatial relationship for ease of assembly.

Each of the sets 76 are identical, and each set includes a pair of sockets 78, each of which is defined by a wall 86, fingers 88 having internal surfaces 90, the finger walls 86 being notched at 92 so as to be of a cantilevered form. Each of the fingers 88 includes webs 94 which function in a manner identical to that disclosed above with respect to the embodiment of FIGS. 1–6.

The sockets 78 of a set 76 are interconnected at their outer region by homogeneous bridges 96, and at their inner regions the sockets are interconnected by a mounting platform 98 located between the sockets of a set. The platforms 98 are homogeneously defined of the material of the guide body 74 and are formed on the ends of the tongues 104 which are slotted at 106 with respect to the associated fingers so as to permit the cantilevered resiliency of the fingers of the socket. However, as the tongues 104 define a portion of the walls of the socket the platforms function to firmly mount the guide upon the engine.

Figure 12:
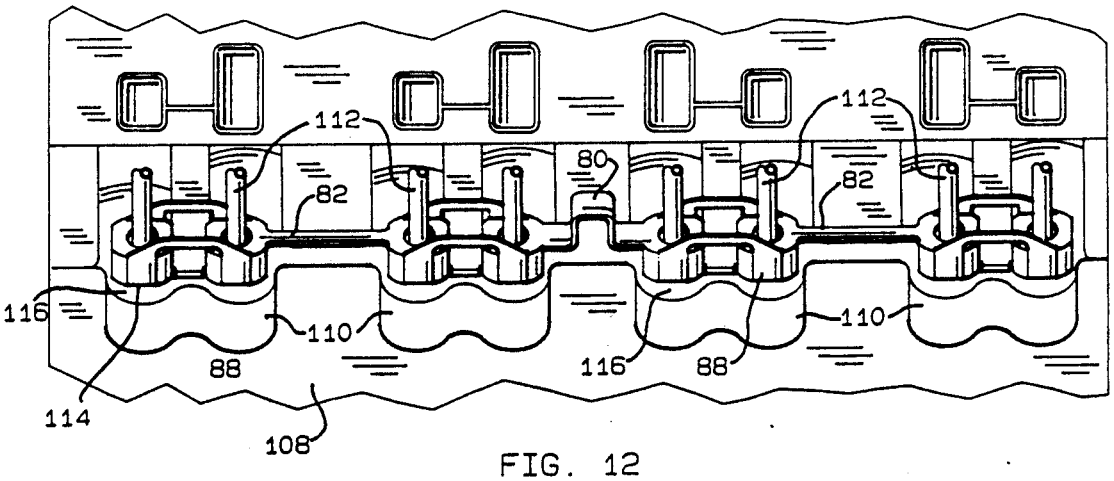
FIG. 12 is a perspective view of the embodiment shown in FIGS. 7-10 as mounted upon an engine.

FIG. 12 illustrates the mounting of the guide embodiment of FIGS. 7–10 to an engine 108 having four embossments 110 in which roller valve lifters, similar to those illustrated in FIG. 13, reciprocate. Valve push rods 112 extend through the axially defined holes in each socket for engaging the outer end of the valve lifters, as described above.

The inner edges 114 of the fingers 88, and the lower surface of the mounting platforms 98, are coplanar, and all rest upon the associated embossment surface 116. Stamped metal retainers of the conventional type used to retain conventional valve lifter guides, not shown, which are bolted to the engine, bear upon the top of the mounting platforms 98 to firmly position the associated set 76 upon the embossment. Also, if desired, holes may be formed in the mounting platforms 98 to receive bolts threaded into engine holes to maintain the body 74 in place, if stamped retainers are not to be used. As described above, the flat surfaces 70 defined on the valve lifter will be engaged by the finger internal surfaces 90 to maintain the proper rotational orientation of the valve lifters.

The lubricity achieved by the use of the nylon reinforced material of the valve lifter guides will insure close and accurate guiding of the valve lifters even under zero clearance interfaces, and by impregnating the material with molybdenum disulfide lubricity is further enhanced. Further, by the utilization of the synthetic polymeric material superior wear characteristics are achieved between the guide and valve lifter, weight is reduced, and the guides of the invention do not require secondary retainers, as is the case with metal valve lifter guides, except in applications where engine bolt holes are not provided in usable locations. The guides of the invention simplify assembly and reduce the likelihood of misassembly.

It is appreciated that various modifications to the inventive concepts may be apparent to those skilled in the art without departing from the spirit and scope of the invention.

I claim:

1. A roller valve lifter anti-rotation guide for internal combustion engine valve lifters reciprocally mounted within an engine bore along an axis and having a pair of substantially parallel spaced flat surfaces defined thereon adjacent a valve lifter end and radially spaced from the lifter axis, comprising, in combination, a body molded of a heat resistant material, engine mounting means defined on said body for mounting said body on an engine adjacent valve lifters to be guided, an elongated socket defined on said body having an axis and adapted to receive the end of a valve lifter having the flat surfaces defined thereon, said socket including and at least being partially defined by a pair of spaced elongated fingers having internal flat surfaces defined thereon in spaced opposed relationship to each other, the spacing between said finger's internal surfaces being substantially equal to the spacing between the valve lifter flat surfaces whereby said finger's internal surfaces engage and receive therebetween the valve lifter flat surfaces and prevent rotation of the valve lifter about its axis.

2. In a roller valve lifter anti-rotation guide as in claim 1, a pair of sockets defined on said molded body adjacent each other having substantially parallel axes defining a set for guiding the pair of valve lifters associated with a cylinder of the associated engine.

3. In a roller valve lifter anti-rotation guide as in claim 2, a plurality of socket sets defined on said molded body.

4. In a roller valve lifter anti-rotation guide as in claim 1, said fingers being cantilever supported upon said molded body each having a free deformable end whereby the valve lifter flat surfaces may be engaged by said finger's internal surfaces, the distance separating opposed fingers at their ends being less than the distance separating the lifter flat surfaces whereby said fingers engage the lifter flat surfaces with zero clearance.

5. In a roller valve lifter anti-rotation guide as in claim 1, said fingers including lateral edge portions and webs defined on said lateral edge portions transversely disposed to the plane of said finger's internal surfaces, said webs reinforcing said fingers against deformation transverse to the plane of said fingers, and being of predetermined configuration to determine the deformation characteristics of the associated finger.

6. In a roller valve lifter anti-rotation guide as in claim 1, an opening defined in said molded body in axial alignment with said socket adapted to receive a valve lifter rod, and valve lifter rod guide means defined on said body adjacent said opening for guiding a valve lifter rod into said opening.

7. In a roller valve lifter anti-rotation guide as in claim 2, said engine mounting means defined on said body comprising a hole defined in said body for receiving a bolt.

8. In a roller valve lifter anti-rotation guide as in claim 2, a mounting platform defined upon said body intermediate said sockets comprising a set.

9. In a roller valve lifter anti-rotation guide as in claim 1, said body being molded of a polyamide glass fiber reinforced material.

10. In a roller valve lifter anti-rotation guide as in claim 1, said body being molded of a ceramic material.

11. In a roller valve lifter anti-rotation guide as in claim 9, said polyamide glass fiber reinforced material being impregnated with a molybdenum disulfide.

12. In a roller valve lifter anti-rotation guide as in claim 3, said socket sets being interconnected by thin wall deformable webs.

13. A roller valve lifter anti-rotation guide comprising, in combination, a body molded of a synthetic polymeric material, engine mounting means defined on said body, and a pair of cantilever supported deformable fingers extending from said body in a common direction each having a free end, said fingers being in spaced relationship to each other adapted to receive a valve lifter therebetween.

14. In a roller valve lifter anti-rotation guide as in claim 13, said fingers each including a flat internal surface, said internal surfaces of said fingers being in spaced opposed relationship to each other and partially defining an elongated socket having an axis, said fingers being on opposite sides of said axis.

15. In a roller valve lifter anti-rotation guide as in claim 14, a pair of sockets defined on said molded body adjacent each other having substantially parallel axes and defining a set.

16. In a roller valve lifter anti-rotation guide as in claim 15, a plurality of socket sets defined on said molded body.

17. In a roller valve lifter anti-rotation guide as in claim 14, said fingers including lateral edge portions and webs defined on said lateral edge portions transversely disposed to the plane of said finger's internal surfaces, said webs reinforcing said fingers against deformation transverse to the plane of said fingers.

18. In a roller valve lifter anti-rotation guide as in claim 14, an opening defined in said molded body in axial alignment with said socket adapted to receive a valve lifter rod, and valve lifter rod guide means defined on said body adjacent said opening for guiding a valve lifter rod into said opening.

19. In a roller valve lifter anti-rotation guide as in claim 12, said body being molded of a polyamide glass fiber reinforced material.

20. In a roller valve lifter anti-rotation guide as in claim 19, said polyamide glass fiber reinforced material being impregnated with a molybdenum disulfide.

* * * * *